United States Patent [19]

Piskula

[11] Patent Number: 4,871,451

[45] Date of Patent: Oct. 3, 1989

[54] FLOOR DRAIN PLATE ASSEMBLY

[76] Inventor: James Piskula, P.O. Box 26174, Milwaukee, Wis. 53226

[21] Appl. No.: 246,434

[22] Filed: Sep. 19, 1988

[51] Int. Cl.[4] ..... E04D 13/00

[52] U.S. Cl. ..... 210/164; 210/232; 52/12

[58] Field of Search ..... 210/164, 163, 162, 232, 210/238; 292/90, 256.73, 256; 52/12; 220/18, 324, 325; 137/362

[56] References Cited

U.S. PATENT DOCUMENTS

| | | | |
|---|---|---|---|
| 1,604,875 | 10/1926 | Bogaty | 292/256 X |
| 1,606,509 | 11/1926 | Campbell | 292/256 X |
| 2,582,816 | 1/1952 | Bonnell | 292/256 X |
| 2,800,231 | 7/1957 | Hicks | 210/163 X |
| 3,212,416 | 10/1965 | Boersma | 210/164 |
| 3,349,917 | 10/1967 | Strickland | 210/164 |
| 4,655,913 | 4/1987 | Boersma | 210/163 |

*Primary Examiner*—David A. Scherbel
*Assistant Examiner*—Lan Mai
*Attorney, Agent, or Firm*—Quarles & Brady

[57] ABSTRACT

An improved floor drain plate assembly for closing the open mouth of a drain includes an apertured floor drain plate having slots and at least two jam clips. Each of the jam clips has a base and a pair of spaced apart legs. The assembly also includes bolts with an enlarged head and nuts for suspending the clips below the plate. When the clips are in place, one of the legs of each clip is jammed into a slot in the drain plate and the second leg can be forced by the tightening of the bolt and nut outwardly to engage the wall of the open mouth of the drain and secure the drain plate therein.

3 Claims, 2 Drawing Sheets

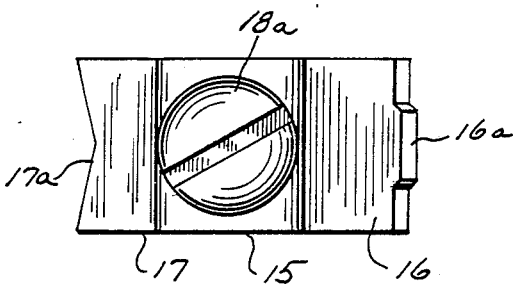
FIG. 3
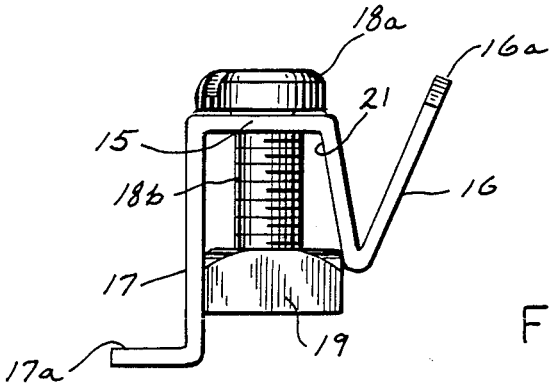
FIG. 4
FIG. 5
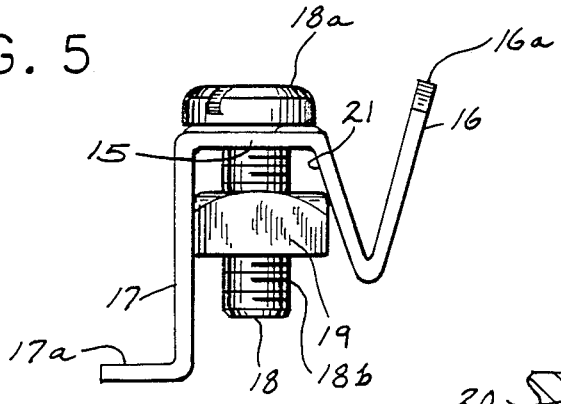
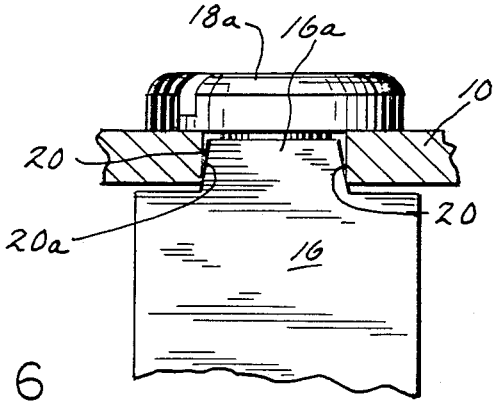
FIG. 6

FLOOR DRAIN PLATE ASSEMBLY

FIELD OF THE INVENTION

The present invention relates to plumbing fittings. More particularly, it relates to a floor drain plate assembly which includes a floor drain plate and means for fastening the plate within the drain opening.

BACKGROUND OF THE INVENTION

The floors of buildings are usually provided with floor drains which provide access to drainpipes which are used to convey liquids spilt or poured on the floors to sewers or collection containers. The open mouth of the floor drain is usually closed with an apertured drain plate which may be friction fit or otherwise secured in place.

In time, the mouth of the drainpipe may become eroded or the floor drain plate cracked so that the mouth of the drainpipe is no longer securely closed. When that occurs the plumber usually attempts to install a new floor drain plate. Unfortunately, in many cases a drain plate of the original design may either be no longer available or if available may not fit securely because of erosion of the mouth of the drainpipe.

There is a need for a universal floor drain plate assembly which can be used to either close the open mouth of a new floor drain or used to replace a floor drain plate which must be replaced for some reason.

There is also a need for an improved inexpensive floor drain plate assembly that can be quickly and easily installed to securely close a variety of different size mouths of floor drains.

BRIEF SUMMARY OF THE INVENTION

It is an object of the present invention to disclose a universal floor drain plate assembly which can be used to either close the open mouth of a new floor drain or used to replace a floor drain plate.

It is also an object to disclose an improved inexpensive, floor drain floor plate assembly that can be quickly and easily installed to securely close a variety of different size mouths of floor drains.

The improved floor drain plate assembly of the present invention comprises an apertured drain plate and unique fastening means which comprises a plurality of jam clips which attached to the bottom of the drain plate and cooperate with the drain plate to secure it in the open mouth of a floor drain.

In the preferred embodiment, the apertured drain plate has at least two opposed slots and the fastening means comprises at least two jam clips with a base and a pair of spaced apart legs and means for attaching the clips to the plate and spreading the legs to receive the plate in the mouth of a floor drain. One of the legs of the preferred clip is bent upwardly to jam into a slot of the drain plate and the other leg has a lateral projection which can frictionally engage the side of the mouth of a floor drain. The means for attaching the clip and spreading the legs is a nut which fits in the tapered space between the legs and a bolt with an enlarged head. The head of the bolt rests on the top of the plate and the threaded body of the bolt extends down through the slot and a hole in the base of the clip into the nut. The bolt when tightened draws the nut upwardly causing the leg of the clip with the lateral projection to move into contact with the wall of the mouth of the drain; the other leg which is bent upwardly is jammed into and becomes anchored in the slot preventing the clip from moving inwardly towards the center of the plate.

When at least two jam clips are thus attached in at least two slots in the plate and the bolts and nuts are tightened so that the lateral projections of the legs engage the side wall of a drain mouth the plate can be secured closing the open mouth of a drain.

The components of the floor drain plate assembly of the present invention may be provided as a kit for the convenience of users.

The aforementioned object and other objects and advantages of the invention will become further apparent to those skilled in the art from the description and drawings.

BRIEF DESCRIPTION OF THE DRAWINGS

In the drawings:

FIG. 3 is a top view of the fastening means shown in FIG. 1;

FIG. 4 is a side view of the fastening means of FIG. 3 with the legs of the jam clip not spread;

FIG. 5 shows the fastening means with the legs of the jam clip spread;

FIG. 6 is an enlarged view showing a leg of the jam clip anchored in a slot in the drain plate.

DESCRIPTION OF THE PREFERRED EMBODIMENT

Figure 1:
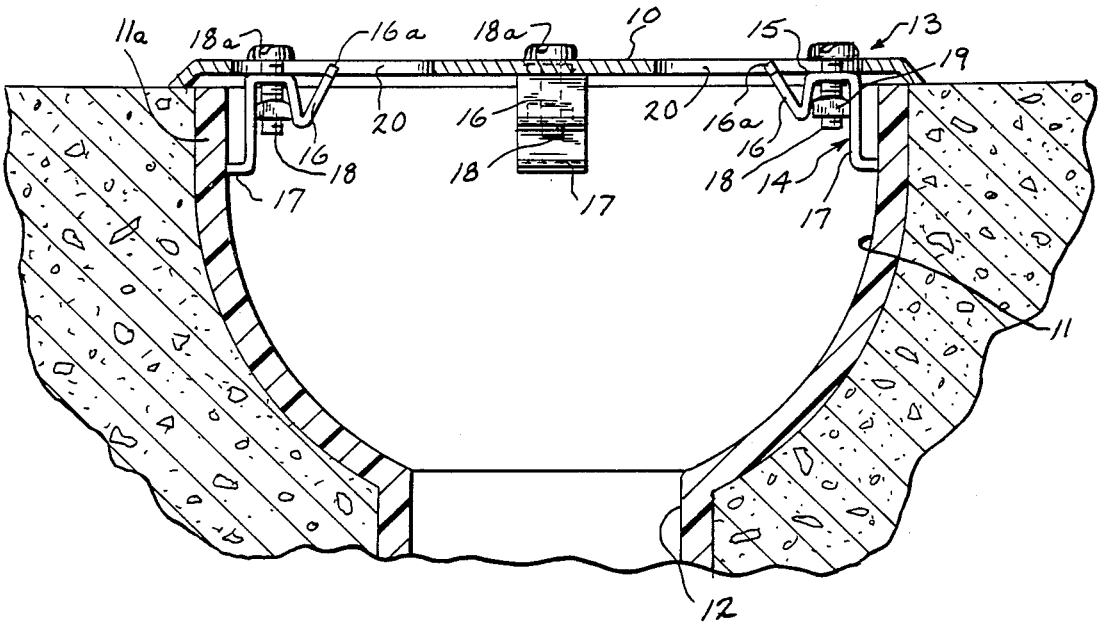
FIG. 1 is an elevational side view, partly in section showing a floor drain assembly of the present invention secured in the open mouth of a floor drain.
Figure 2:
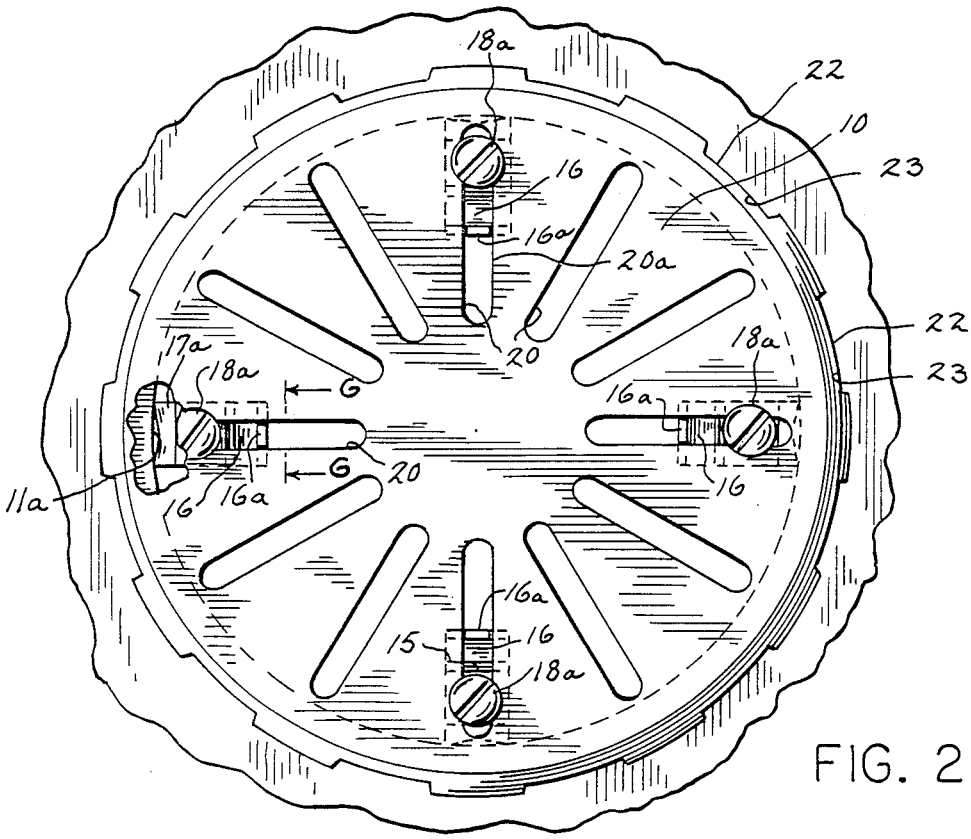
FIG. 2 is a top view, partly in section of the drain plate assembly of FIG. 1.

As seen in FIGS. 1 and 2 the drain plate assembly of the present invention comprises an apertured floor drain plate 10 which is secured in the open mouth 11 of a floor drain 12 by a plurality of fastening means 13.

As seen best in FIGS. 3 to 6, the plate 10 is held in the mouth 11 by fastening means 13 comprising a jam clip 14 which has a base 15, pair of spaced apart legs 16 and 17 and means for attaching the clip 14 to the plate 10 which comprises a bolt 18 and a nut 19.

Turning to FIGS. 1, 4 and 5, it can be seen that the two legs of the clip 14 are not the same. The first leg 16 is generally V shaped and has a tapered, spade-like tip **16*a* which, as seen best in FIG. 6, is bent upwardly and engages the side walls 20*a* of a slot 20 in the drain plate 10. The tip 16*a* is prevented from moving along the slot 20 by the side walls 20*a* of the slot 20**. If desired, the side walls may be serrated.

Referring to FIGS. 1, 3, 4 and 5, it can be seen that the other leg 17 of the clip 14 is L shaped and extends downwardly from the base 15 of the clip 13. To more securely grip the wall **11*a* the tip 17*a* of the leg 17 can be notched as seen in FIG. 3**.

In the preferred embodiment seen in FIGS. 1 and 2, four of the fastening means 13 are used to secure the plate 10 in the mouth 11 of the floor drain 12. When each of the fastening means 13 is attached to the plate 10 by the bolt 18 and the nut 19, the head **18*a* of the bolt 18 rests on the top of the plate 10, the body 18*b* of the bolt 18 extends through the slot 20 and an opening (not shown) in the base 14 of the clip and into the nut 19 which is positioned in the tapered space 21 between the legs 16 and 17. When the bolts 18 are tightened, the nuts 19 are drawn upwardly in the tapered space 21 (seen best in FIGS. 4 and 5) and the legs 16 and 17 are spread until the legs 16 of each of the clips 14 are jammed and anchored in a slot 20 and the legs 17 grip the wall 11***a* of the mouth 11 of the drain 12 and secure the plate 10 in position.

When the plate 10 is secured closing the mouth 11 of the drain 12 as seen in FIG. 1, any liquid on the floor will be able to flow into the drain either via the slots 20 or the openings 22 seen only in FIG. 2 which are formed by the cutouts 23 along the periphery of the plate 10 and the floor.

For the convenience of plumbers and other users a kit consisting of a drain plate and a plurality of fastening means can be provided.

It will be readily apparent to those skilled in the art that the floor drain assembly of the present invention provides significant advantages over that which has been previously available. For example, the floor drain assembly of the present invention can be used to close drain mouths of a variety of different diameters. It also can be used to close drain mouths in which the wall of the opening has been eroded or is otherwise irregular.

It also will be appreciated that a number of changes and modifications can be made in the shapes of the drain plate and the fastening means without departing from the spirit and scope of the invention. Therefore it is intended that the invention not be limited except by the claims which follow.

I claim:

1. A floor drain plate assembly for closing the open mouth of a drain, said assembly comprising a floor drain plate with a plurality of slots in the top thereof, and fastening means comprising at least two jam clips each having a pair of legs and means for attaching the clips to the underside of the plate so that one leg of each clip is anchored in a separate slot and the other leg of each clip can be moved outwardly to engage the wall of a mouth of a drain to secure the drain plate closing said mouth, said jam clips each having a space between said two legs and one of said legs being bent upwardly so that it can engage a slot in the drain plate and the second of said legs having a lateral projection to engage a wall of the drain mouth.

2. The assembly of claim 1 in which the means for attaching the jam clips to the plate comprise a bolt with an enlarged head which rests on the top of the plate and a threaded body which extends through a slot into a nut positioned in the space between the two legs of the clip so that when the bolt and nut are tightened the nut is drawn upwardly in the space and the second leg extends outwardly into contact with the wall of the mouth of the drain.

3. A drain plate assembly kit comprising a circular apertured floor drain plate having opposed slots and fastening means comprising at least two jam clips each having a pair of spaced apart legs and means for attaching the clips to the underside of the plate and spreading the legs to anchor the plate in the open mouth of a floor drain, said means comprising a nut positioned in a tapered space between the two legs of each clip and a bolt for drawing the nut towards the base of the clip to force the second leg of the clip into contact with the wall of the drain mouth.

* * * * *